United States Patent [19]

Simko

[11] Patent Number: 4,561,391

[45] Date of Patent: Dec. 31, 1985

[54] FOUR VALVE FOR CYLINDER ENGINE WITH SINGLE OVERHEAD CAMSHAFT

[75] Inventor: Aladar O. Simko, Dearborn Heights, Mich.

[73] Assignee: Ford Motor Company, Dearborn, Mich.

[21] Appl. No.: 719,942

[22] Filed: Apr. 4, 1985

[51] Int. Cl.[4] ..... F01L 1/02

[52] U.S. Cl. ..... 123/90.27; 123/90.39; 123/90.4

[58] Field of Search ..... 123/90.27, 90.39, 90.40, 123/90.41

[56] References Cited

U.S. PATENT DOCUMENTS

| | | | |
|---|---|---|---|
| 1,415,167 | 5/1922 | Fuchs | 123/90.27 |
| 1,459,630 | 6/1923 | Lanzerotti Spina | 123/90.27 |
| 2,939,443 | 6/1960 | Oechsner | 123/90.41 |
| 3,139,870 | 7/1964 | Sampietro | 123/90.41 |
| 3,412,720 | 11/1968 | Binder | 123/90.27 |
| 3,430,614 | 3/1969 | Meacham | 123/90.27 |
| 3,967,601 | 7/1976 | Herberle | 123/90.39 |
| 4,267,811 | 5/1981 | Springer | 123/90.27 |

FOREIGN PATENT DOCUMENTS

| | | | |
|---|---|---|---|
| 77519 | 6/1981 | Japan | 123/90.39 |

*Primary Examiner*—Ira S. Lazarus

*Attorney, Agent, or Firm*—Clifford L. Sadler; Robert E. McCollum

[57] ABSTRACT

A compact four valve per cylinder overhead camshaft valve train arrangement for use with small cylinder bore engines is made possible by the mounting of a single overhead camshaft at a position high over the cylinder head and laterally offset from the cylinder bore centerline and adjacent a rocker arm shaft that is mounted on the cylinder bore centerline diagonally beneath the camshaft and in turn mounts a single forked lever type rocker arm for the simultaneous actuation of two exhaust valves, and a pair of individual axially spaced rocker arms directed to the opposite side of the rocker arm shaft for actuating a pair of intake valves, roller type cam followers being used to reduce friction, the arrangement providing access to the center of the cylinder bore for the mounting of a spark plug below and beneath the rocker arm shaft and between the intake valve rocker arms and the intake valves.

4 Claims, 2 Drawing Figures

FOUR VALVE FOR CYLINDER ENGINE WITH SINGLE OVERHEAD CAMSHAFT

Figure 1:
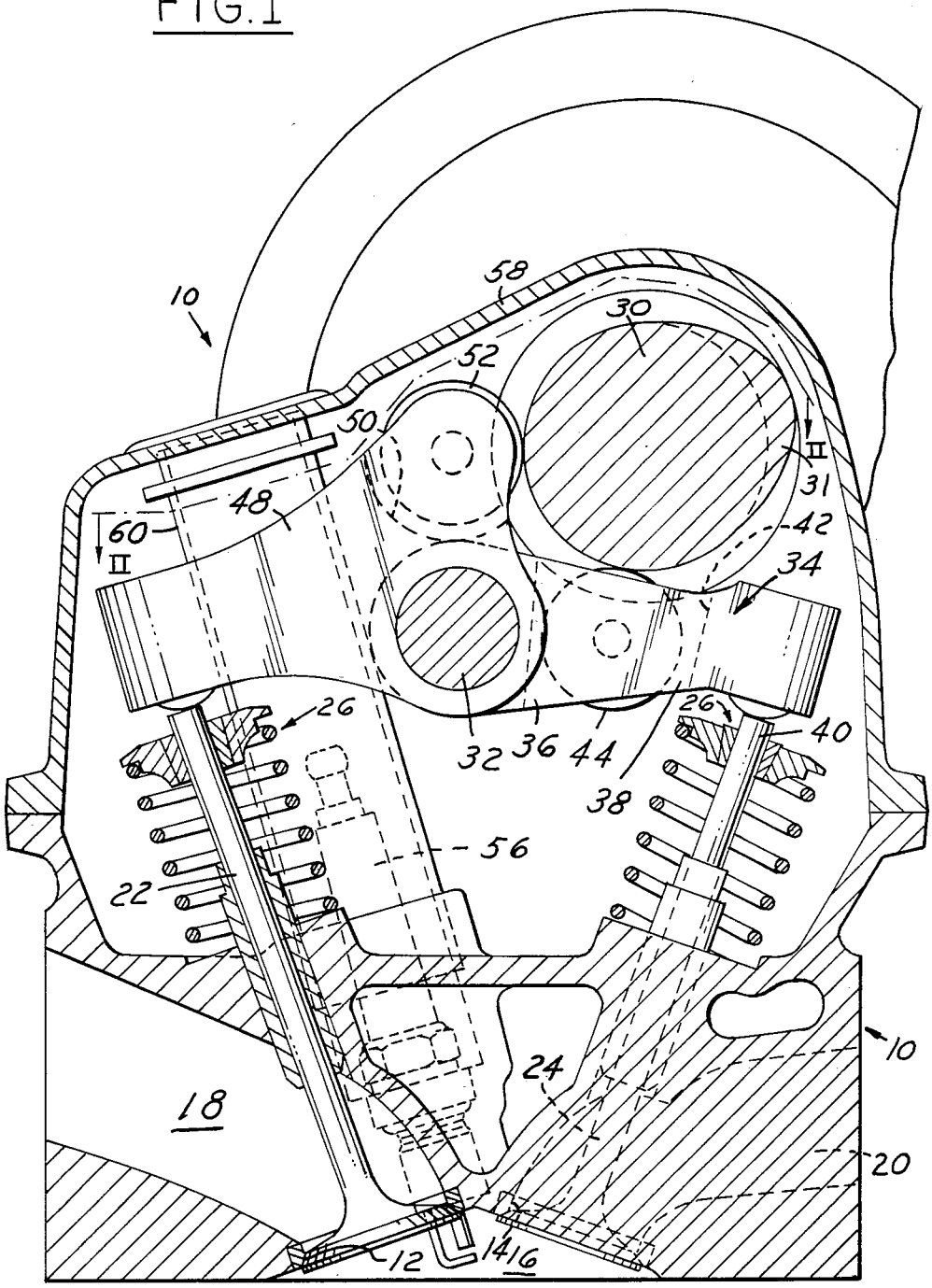

This invention relates in general to a small cylinder bore automotive type engine, and more particularly to the layout of a compact engine valve train having four valves per cylinder actuated by a single overhead camshaft.

Four valve engines with central spark plugs are well known for their high specific output because of large valve area availability coupled with low flow resistance porting. The favored valve activation is by a double overhead camshaft, either with bucket type or finger cam type followers. When this concept is considered for passenger car engines, however, the problems of high cost, large cylinder head dimensions and increased valve train drive torque appear as deterrents.

The single overhead camshaft layout, however, preserves a large fraction of the advantages of the double overhead cam, four valve engines, since it provides reduced cost, reduced bulk, and reduced valve train friction. The arrangement for four valves and a central spark plug, with a single overhead camshaft, however, is difficult on cylinder bores smaller than about 93 mm because there generally is not enough room for the spark plug to pass through between two valves. For good combustion characteristics, however, the spark plug must be close to the bore center.

The valve train arrangement according to the invention accomplishes the above objectives by providing a high position, laterally offset, single overhead camshaft, a central rocker shaft, and a unique valve activation mechanism of individual rocker arm actuated intake valves and a common forked rocker arm for actuating the exhaust valves, the arrangement providing room for the spark plug to pass through a space established beneath the rocker shaft and between the intake rocker arms and intake valves.

An arrangement of four valves per cylinder with a single overhead camshaft, and even the use of forked rocker arms to simultaneously actuate two valves is known. It is also known to centermount the spark plug. However, this usually is made possible only because the installation is in a large engine with large intake and exhaust valves where there is room to accomplish the above. In small cylinder bore engines, such as 93 mm or less, a compact arrangement such as described is not shown in the prior art. For example, U.S. Pat. No. 1,415,167, Fuchs, shows a four cylinder valve engine having a forked rocker arm for actuating two exhaust valves and individually actuated intake valves; however, the valves are parallel mounted with an overhead camshaft located on the engine cylinder centerline and a rocker arm shaft directly beneath the camshaft. The non angling of the valves require large ports, a bulky mechanism, and a costly assembly. The arrangement is not suitable for a small bore engine.

Similarly, U.S. Pat. No. 3,139,870, Sampietro, shows an engine having parallel mounted valves with a laterally offset camshaft, four valves per cylinder, a rocker arm shaft beneath and laterally of the camshaft, and rollers for actuating the rocker arms. However, the arrangement is large and bulky and complex and again not suitable for a small bore engine. The non angling of the valves obviously requires a very large cylinder bore.

U.S. Pat. No. 3,967,601, Heberle, shows a four valve per cylinder engine with a forked lever for actuating two of the valves with the remaining two being individually actuated; however, parallel valves are shown requiring a large engine bore and a complex and bulky valve train arrangement of rocker arms with the rocker arm for actuating a single valve being twice as long and complex as the forked rocker arm.

U.S. Pat. No. 4,267,811, Springer, shows four valves per cylinder with the valves angled for compactness and a single overhead camshaft, the camshaft, however, being located on the cylinder bore centerline and beneath a pair of rocker arm shafts on opposite sides of the camshaft. Such an arrangement does permit the installation of a centrally located spark plug. However, it also requires the use of two parallel rocker arm shafts, and as seen in FIG. 2, increases the mass and/or bulk of the assembly.

The invention provides a simple, compact installation of four valves per cylinder bore in a small cylinder bore engine with a single overhead camshaft located high in the cylinder head and laterally offset from the centerline of the cylinder bore and above and diagonally located with respect to a single rocker arm shaft located on the engine centerline and an arrangement of intake and exhaust valve rocker arms permitting the inclined installation of a spark plug directly in the center of the combustion chamber dome.

It is a primary object of the invention, therefore, to provide a valve train arrangement that includes four valves per cylinder, a single centrally mounted spark plug, and single overhead camshaft, with individually roller actuated intake valves and a forked lever type exhaust valve actuator, the arrangement obtaining most of the benefits of the use of four valves without excessive bulk and cost.

Figure 2:
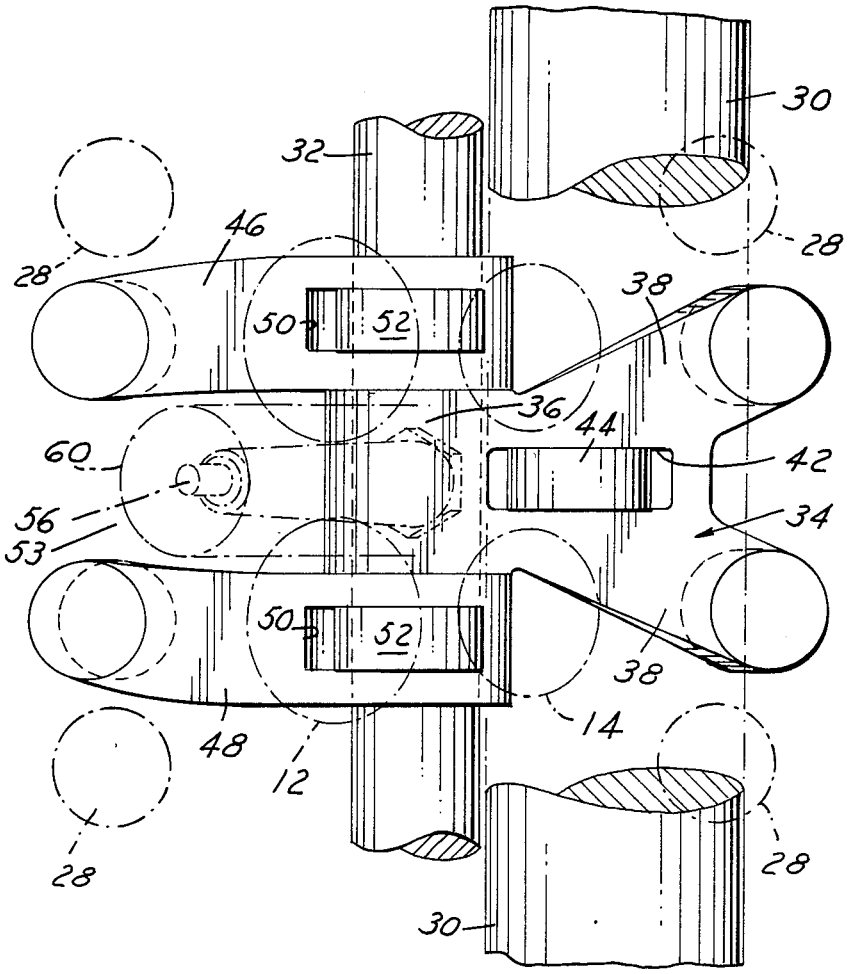

Other objects, features and advantages of the invention will become more apparent upon reference to the succeeding, detailed description thereof, and to the drawings illustrating the preferred embodiment thereof: wherein, FIG. 1 is a cross-sectional view of a portion of an engine valve train embodying the invention; and FIG. 2 is a cross-sectional view taken on a plane indicated by and viewed in the direction of the arrows II—II of FIG. 1.

FIG. 1 shows a portion 10 of a conventional cylinder head having the usual intake and exhaust ports 12 and 14 opening into a combustion chamber 16. The ports are connected by respective passages 18 and 20 to opposite sides of the cylinder head for a cross flow operation. Each of the ports has mounted therein a valve 22, 24 that is spring loaded closed by means of the usual valve train assembly 26 shown. The valves are angled, and actuation of the respective valves is accomplished in this case by a particular rocker arm mechanism to be described.

More particularly, a single overhead camshaft 30 having a number of cans 31 (only one shown) is mounted at a location high above the cylinder head and laterally offset from a vertical plane containing the engine cylinder centerline. Diagnonally adjacent and below camshaft 30 is a rocker arm shaft 32 upon which are pivotally mounted the respective rocker arms for actuation of the intake and exhaust valves.

In this case, one complete valve actuating mechanism for each cylinder is compactly located within the space defined between four cylinder head bolts indicated at 28. Projecting rightwardly as seen in the figures is a forked rocker arm 34 having a base apex sleeve portion 36 that is mounted on the rocker arm shaft, and a pair of diagonally directed exhaust valve actuating arms 38. The end of each arm 38, as best seen in FIG. 1, is engaged with the tip of an exhaust valve stem 40. The apex portion 36 of the forked arm is provided with a recess 42 within which is rotatably mounted a roller 44 engagable as shown in FIG. 1 with the camshaft 30 for an arcuate pivotal movement of the rocker arm to simultaneously actuate the exhaust valves to an open position.

The intake valves 24 are actuated by individual axially spaced rocker arms 46, 48 each rotatably mounted at one end on the rocker arm shaft 32 and bearing against the tip of the intake valve stem 40 at its opposite end. Each intake valve rocker arm is provided with a recess 50 within which is rotatably mounted a roller 52 that bears against the periphery of cam 31 on the camshaft 30.

With the arrangement as described above, and as best seen in FIG. 2, a clearance space 53 is provided between the intake valve rocker arms 46, 48 and the intake valves and below the rocker arm shaft 32 to permit the angled installation of a spark plug 56 on the cylinder bore centerline, as indicated. The spark plug thus is mounted in the center of the bore for a most effective installation. In this case, installation is made easier by the insertion through the valve cover 58 and cylinder head of a tubular guide 60 through which the plug can be inserted.

From the foregoing, it will be clear that the invention provides a compact valve train arrangement for a small bore, four valve per cylinder engine that permits the installation of a spark plug on the cylinder bore centerline without complexity and in an economical manner. A single, forked rocker arm activates two exhaust valves simultaneously, the apex of which is located between a pair of individual intake valve rocker arms, each employing cam follower rollers for a low friction durability and to facilitate the use of narrow cam lobes.

While the invention has been shown and described in its preferred embodiment, it will be clear to those skilled in the arts to which it pertains that many modifications and changes may be made thereto without departing from the scope of the invention.

I claim:

1. A valve train construction for a small cylinder bore engine having four valves per cylinder each angled with respect to one another and a centrally located spark plug, comprising a single high position overhead engine driven camshaft having an axis of rotation offset laterally with respect to a vertical plane containing the engine cylinder centerline, a single centrally located rocker arm shaft positioned beneath the camshaft on the engine cylinder centerline, and a plurality of rocker arm means pivotally mounted on the shaft and operatively engagable individually each with one of the valves for successively actuating the same upon rotation of the camshaft, the spark plug projecting to the cylinder bore center in a clearance space defined between a pair of the rocker arms and axially adjacent valves beneath the rocker arm shaft.

2. A valve train construction as in claim 1, wherein the valves include a pair of intake valves located to one side of the cylinder bore and a pair of exhaust valves located oppositely thereto, the intake valves being actuated simultaneously by individual axially spaced rocker arms, the exhaust valves being actuated by a single forked rocker arm.

3. A valve train construction as in claim 2, each rocker arm including a roller engagable with the camshaft for a reduced friction actuation of the rocker arm thereby, an opposite end of the rocker arm being engagable directly with the end of a valve for actuation thereof.

4. A valve train construction as in claim 3, the pair of rocker arms for actuating the intake valves extending laterally to one side of the cylinder bore centerline, the single forked rocker arm extending in the opposite direction to the opposite side of the cylinder bore centerline.

* * * * *

UNITED STATES PATENT AND TRADEMARK OFFICE

CERTIFICATE OF CORRECTION

PATENT NO. : 4,561,391

DATED : December 31, 1985

INVENTOR(S) : Simko, Aladar O.

It is certified that error appears in the above-identified patent and that said Letters Patent is hereby corrected as shown below:

The title of the invention should read as follows:

--FOUR VALVE PER CYLINDER ENGINE WITH SINGLE OVERHEAD CAMSHAFT--.

Signed and Sealed this

*Eighteenth* Day of *March 1986*

[SEAL]

*Attest:*

DONALD J. QUIGG

*Attesting Officer*

*Commissioner of Patents and Trademarks*